US006019052A

United States Patent [19]

Stucki et al.

[11] Patent Number: 6,019,052

[45] Date of Patent: Feb. 1, 2000

[54] METHOD AND APPARATUS FOR EMBROIDERING TUBULAR MATERIAL

[75] Inventors: André Stucki, Steckborn; Erwin Hilber, Tagerwilen, both of Switzerland

[73] Assignee: Fritz Gegauf Aktiengesellschaft, Steckborn, Switzerland

[21] Appl. No.: 09/039,757

[22] Filed: Mar. 16, 1998

[30] Foreign Application Priority Data

Apr. 28, 1997 [CH] Switzerland ..... 00991-97

[51] Int. Cl.[7] ..... D05C 5/02

[52] U.S. Cl. ..... 112/102.5; 112/475.19

[58] Field of Search ..... 112/103, 102.5, 112/470.06, 470.14, 470.29, 10, 63, 475.04, 475.08, 475.09, 475.11, 475.19, 475.18

[56] References Cited

U.S. PATENT DOCUMENTS

| | | | |
|---|---|---|---|
| 4,998,489 | 3/1991 | Hisatake | 112/103 |
| 5,167,194 | 12/1992 | Nakagaki | 112/103 |
| 5,666,894 | 9/1997 | Jonsson et al. | 112/103 |
| 5,832,853 | 11/1998 | Pokrishevsky et al. | 112/103 X |

FOREIGN PATENT DOCUMENTS

| | | | |
|---|---|---|---|
| 2-104760 | 4/1990 | Japan | 112/103 |
| 3-207392 | 9/1991 | Japan | 112/103 |
| 4-354969 | 12/1992 | Japan | 112/103 |

*Primary Examiner*—Peter Nerbun
*Attorney, Agent, or Firm*—Edwin D. Schindler

[57] ABSTRACT

A method for embroidering tubular material and the use of an embroidering apparatus therewith, in which the embroidering apparatus includes an embroidering device which is attachable to a free-arm sewing machine. The embroidering device has an embroidering frame, which is horizontally displaceable above the free arm of the sewing machine by a first drive in the X-direction and by a second drive in the Y-direction. An intermediate space is formed, permitting the introduction of a tubular material between the embroidering device and the free arm of the sewing machine. By forming an intermediate space between the free arm and the embroidery device, it is becomes possible to clamp tubular textiles and the like, without obstruction, in an embroidery frame and to pull such materials across the free arm of the sewing machine in order to provide the material with embroideries.

11 Claims, 4 Drawing Sheets

METHOD AND APPARATUS FOR EMBROIDERING TUBULAR MATERIAL

BACKGROUND OF THE INVENTION

1. Technical Field of the Invention

The present invention relates, generally, to a method and apparatus for embroidering tubular material.

More particularly, the present invention relates to a method for embroidering tubular material and the use of an embroidering apparatus therewith, in which the embroidering apparatus includes an embroidering device which is attachable to a free-arm sewing machine. The embroidering device has an embroidering frame, which is horizontally displaceable above the free arm of the sewing machine by first drive means in the X-direction and by second drive means in the Y-direction. An intermediate space is formed, permitting the introduction of a tubular material between the embroidering device and the free arm of the sewing machine.

2. Description of the Prior Art

It is known to the prior art how to attach embroidery devices to sewing machines, so that the sewing machine can also be used as an embroidery machine with a controlled embroidery frame. In German Utility Patent No. DE-29614512 U1, the embroidery frame is supported on the embroidery frame carrier of such an embroidery device and displaceable in the X- and Y-directions. The embroidery device is designed as an assembly: It has a substantially L-shaped plan and it fully abuts the free arm on both the back and front sides of the sewing machine and is detachably connected with said free arm. The surface of the embroidery device and the surface of the free arm form a common, closed work surface.

Japanese Patent Application No. 04-354969 discloses a further embroidery device known to the prior art, which is designed in an L-shaped manner. The embroidery device of this prior art fully abuts the front side, as well as the face of the free arm and it is rigidly joined with the machine. The electrical energy and the control signals are supplied via an exposed flexible cable.

Embroidery patterns can be produced with apparatus known to the prior art on flat fabrics. However, it is not possible with such devices to embroider tubular or hose-like textiles, such as the sleeves of blouses or T-shirts and the like, which is a significant drawback.

SUMMARY OF THE INVENTION

It is, therefore, an object of the present invention to provide an embroidery method and related apparatus by which both flat and tubular structures can be embroidered.

The foregoing and related objects are provided by the method of the present invention for embroidering tubular material and the use of an embroidering apparatus therewith, also within the scope of the present invention, in which the embroidering apparatus includes an embroidering device which is attachable to a free-arm sewing machine. The embroidering device has an embroidering frame, which is horizontally displaceable above the free arm by first drive means in the X-direction and by second drive means in the Y-direction. An intermediate space is formed, permitting the introduction of a tubular material between the embroidering device and the free arm of the sewing machine.

By forming an intermediate space between the free arm and the embroidery device, it is surprisingly possible to clamp tubular textiles and the like, without obstruction, in an embroidery frame and to pull such materials across the free arm in order to provide the material with embroideries. By using a spacer element, adequate space is created, so as to be able to easily insert the tubular parts of material and to move them while they are being embroidered. Provision is made on the spacer element for fastening means, which produces a stable mechanical connection between the embroidery device and the base plate of the sewing machine. An electrical connection, between the sewing machine and the embroidery device, which is required for controlling the embroidery frame and conventionally established via a flexible cable, remains unchanged from that known to the prior art.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
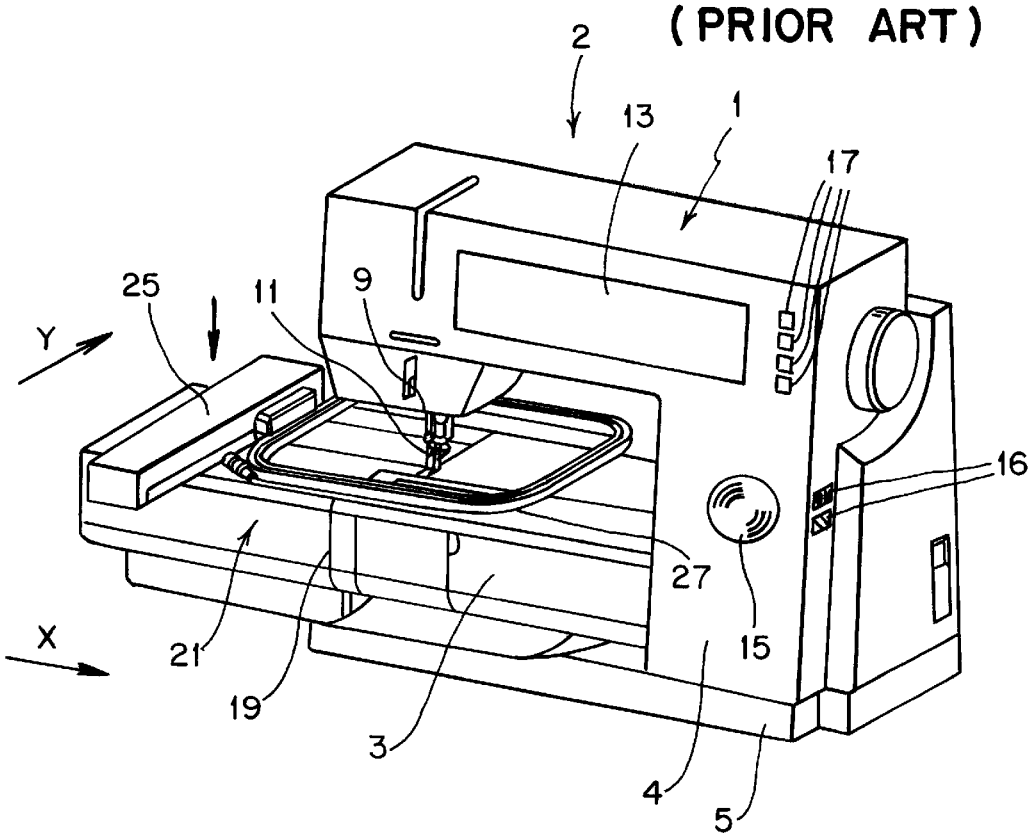
FIG. 1 (PRIOR ART)
FIG. 1 is a diagrammatic representation of a sewing machine having an embroidery unit directly attached to the sewing machine, as is known to the state of the art.

FIG. 1 shows a sewing machine 2, the structure of which will not be explained in greater detail since such structure is conventional, well known to the art and not important for understanding and achieving the intended benefits of the present invention. Only those parts of sewing machine 2 which are required for explaining the invention are denoted and discussed in greater detail hereinafter.

Turning now, in detail, to an analysis of the drawing figures, reference numeral 1 denotes the housing of sewing machine 2, which is mounted on a base plate 5 and has a substantially L-shaped design. Free arm 3 is arranged on vertical leg 4 of machine housing 1 with a spacer from base plate 5. The catcher is drivably supported (not visible) on the free end of said free arm below stitch hole 7. A needle 11 is inserted in needle bar 9 above stitch hole 7. On the front side of machine housing 1, facing the user, a display screen 13 is schematically shown in the form of a rectangle. Alternatively, provision could be made for a display or control unit designed in another manner. Additionally, on the same side thereof, provision is made on machine housing 1 for a rolling ball 15. The associated control keys are denoted by reference numeral 16. Another row 17 of keys serves for selecting special functions. All elements needed for guiding the thread and the latter itself are not denoted nor shown because said elements are not required for describing the present invention and their design has no bearing on the invention.

Figure 2:
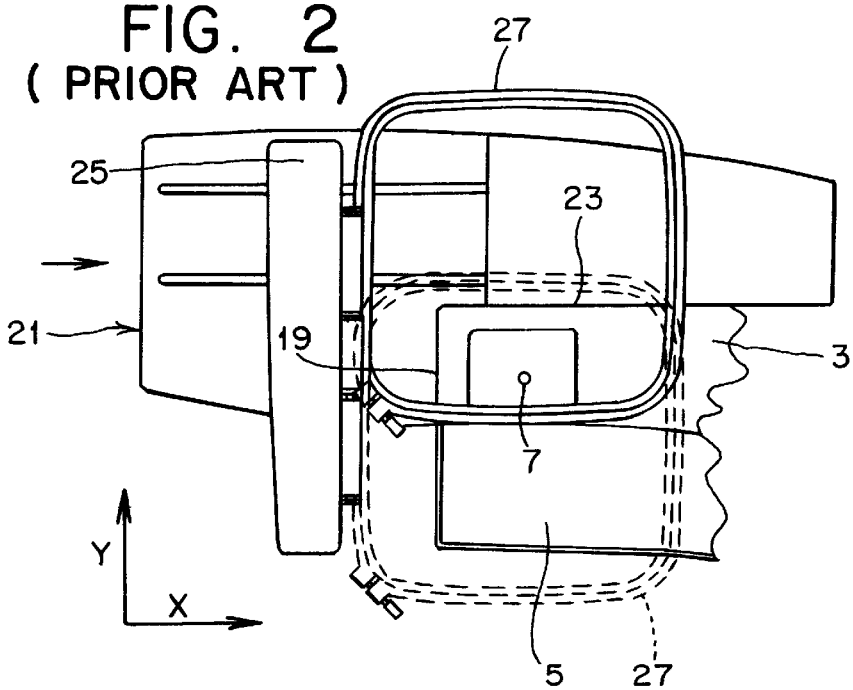
FIG. 2 ( PRIOR ART )
FIG. 2 is a top view of the free arm of the sewing machine and the embroidery unit of the prior art arrangement in accordance with FIG. 1.

An embroidery device 21 adjoins front end 19 of free arm 3. Said embroidery device fully abuts flush on back side 23 of free arm 3, and is mechanically connected with sewing machine 2 by means not shown. An embroidery frame 27 is drivably mounted on embroidery frame carrier 25 and displaceable in the Y-direction. A possible way of designing the elements for driving embroidery frame 27 is described in German Utility/Design Patent No. 29614512 U1. The driving means for the X- and Y-movements of an embroidery frame are sufficiently well known from the state of the art. By means of a suitably designed controller (not shown in detail), embroidery frame 27 can be driven in a conventional manner along a programmable path. Accordingly, free programmable embroidery patterns can be produced with sewing machine 2 on a textile structure clamped in embroidery frame 27. The positions of embroidery device 21 and free arm 3 of sewing machine 2, relative to each other, are shown in FIGS. 1 and 2 and correspond with the state of the art.

Figures 3, 7:
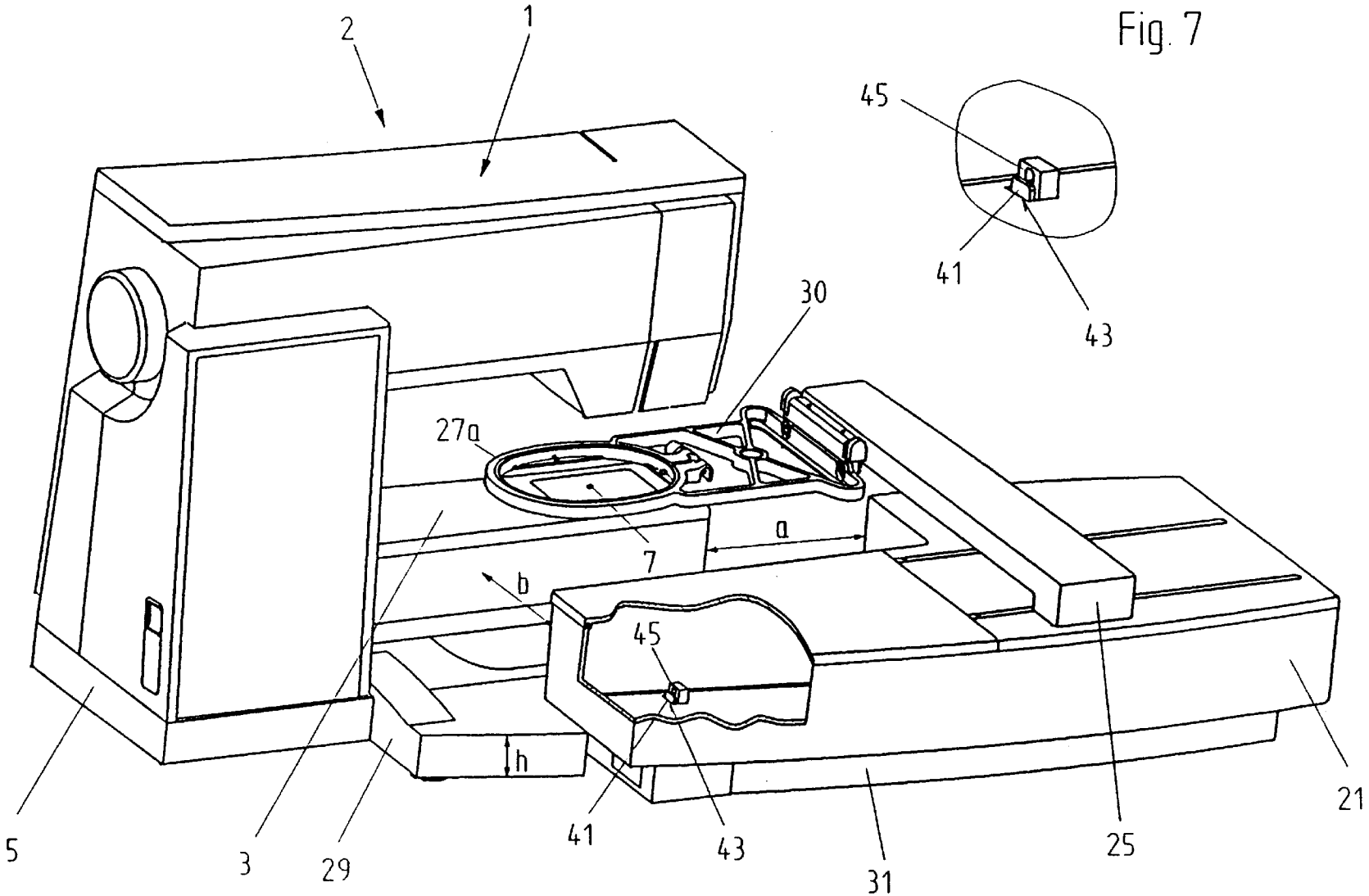
FIG. 3 is a diagrammatic representation of a sewing machine, with an embroidery unit mounted thereon, by means of the spacer element in accordance with the present invention.
Figure 6:
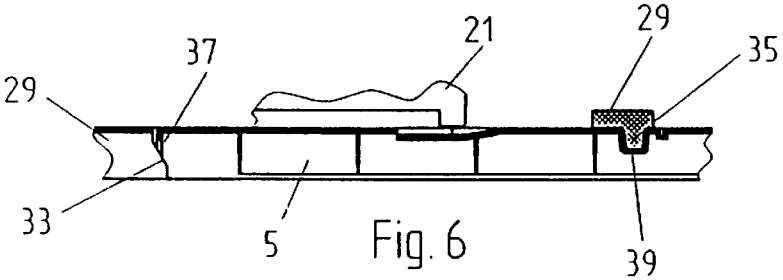
FIG. 6 is a sectional view taken through the mounting device of the invention, along the line VI—VI in FIG. 4; and, FIG. 7 is a partial view of the embroidery unit of the invention shown cut open.
Figure 4:
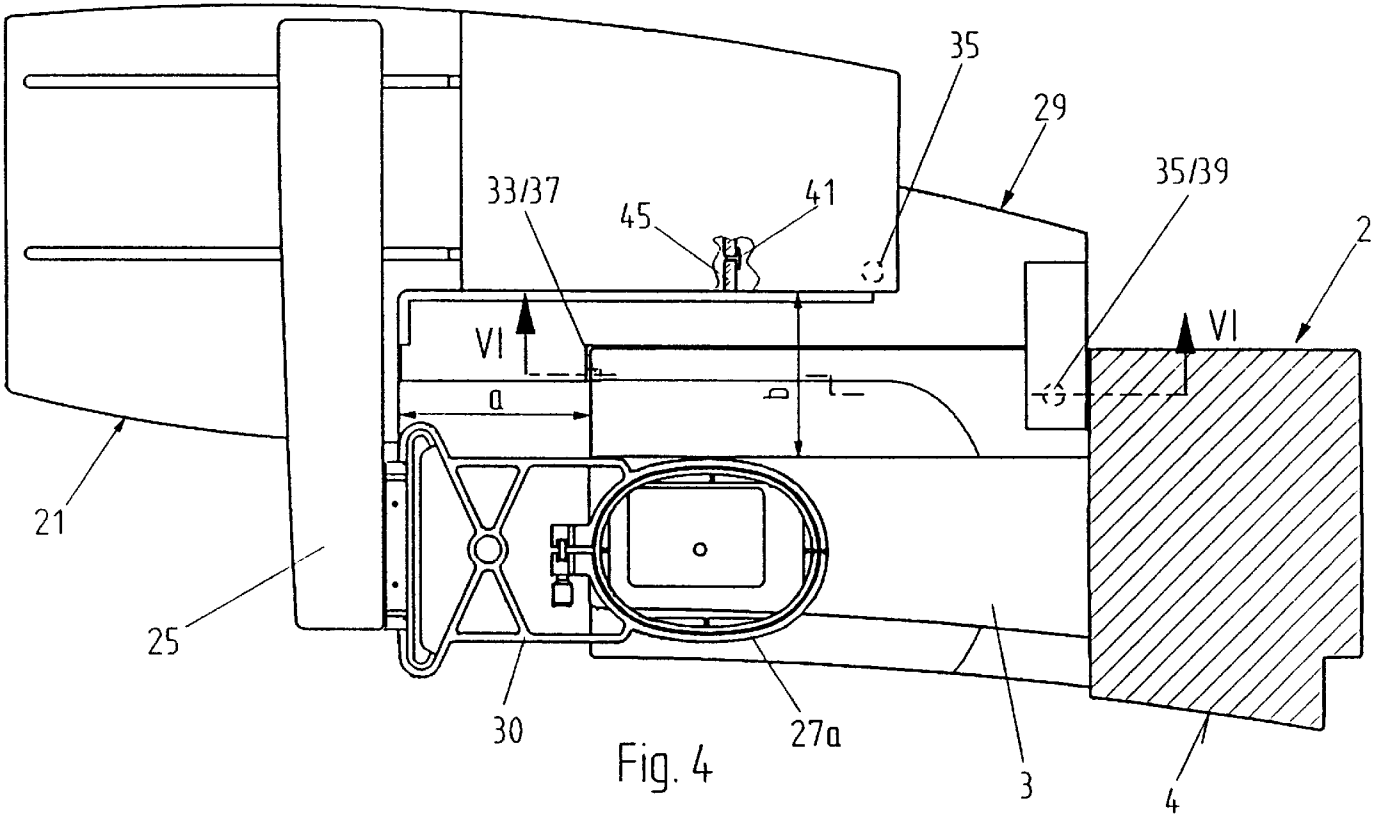
FIG. 4 is a top view of the free arm of the sewing machine and embroidery unit mounted thereon by means of a spacer element, with an embroidery frame in accordance with FIG. 3 and the present invention.

In the arrangement as defined by the present invention, and as shown in FIGS. 3 and 4, embroidery device 21 is disposed in both X- and Y-directions with spacings "a" and "b" from face 19 and, respectively, back side 23 of free arm 3, forming an intermediate space. A spacer element 29 is inserted between base plate 5 of sewing machine 2 and embroidery device 21. Height "h" of spacer element 29 corresponds, approximately, with the height of base plate 5, so that free access is assured for introducing tubular material via the freely suspended end 19 of free arm 3.

Figure 5:
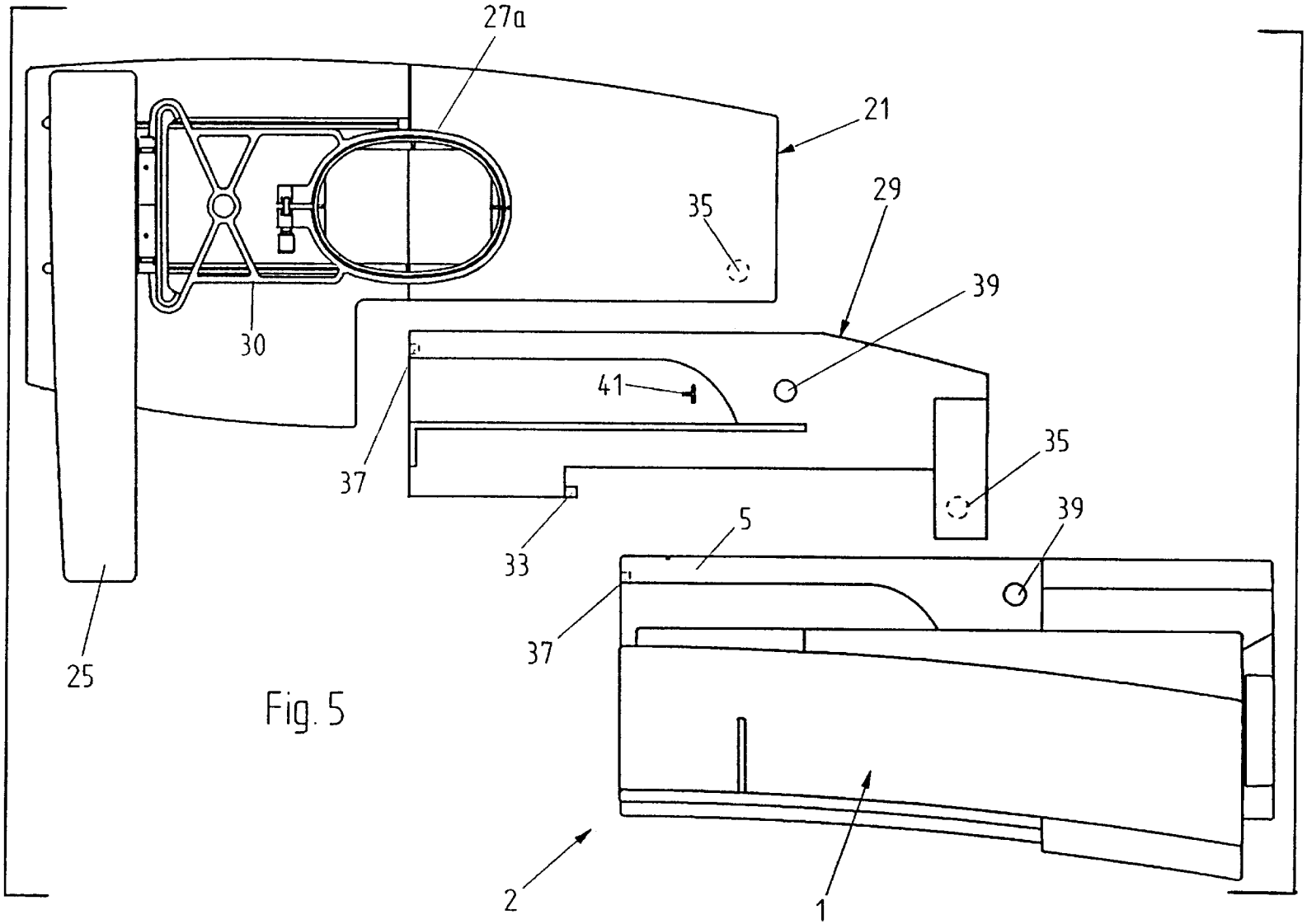
FIG. 5 is a diagrammatic representation of the sewing machine, the embroidery unit and the spacer element, in which the various elements are shown separated from one another.

Spacer element 29 comprises mechanical retaining and centering means permitting an exactly positioned connection of embroidery device 21 with base plate 5 and sewing machine 2. A rib-like, horizontal cam 33 and cylindrical cam 35 with a vertical axis, said cams being formed on spacer 29, serve as fastening and centering means. The two cams 33, 35 engage mating recesses 37, 39 on base plate 5 (see, FIG. 5.) The connection between embroidery device 21 and spacer element 29 is established analogously. Therefore, a direct connection between embroidery device 21 and sewing machine 2 can also be made with the same means when flat textiles are to be embroidered. A cam 41, which vertically projects beyond the surface of spacer element 29 and which engages the housing of embroidery device 21 from the bottom through a recess 43, cooperates with scanning means 45 in order to scan for the presence of spacer element 29. When embroidery device 21 is secured on sewing machine 2, scanning means 45 triggers a signal to the controller, so that the latter only releases embroidery pattern control data for a limited embroidery zone or range. Scanning means 45, preferably, comprises a light barrier, which is actuated by cam 41 acting as a shutter. The electrical power and control connections between embroidery device 21 and sewing machine 2 may be established in a conventional manner via an externally installed cable or by plug connections (not shown.) The plug connection can be designed so that they are simultaneously connected when spacer element 29 is plugged together with base plate 5 of sewing machine 2 and with embroidery device 21.

When embroidery device 21 is connected to sewing machine 2, with the assistance of spacer element 29, embroidery device 21 no longer abuts free arm 3, but is displaced versus the latter by spacings "a" and "b," respectively (see, FIG. 4.) This results in a limited exploitation of the embroidery area, as compared to the application of embroidery device 21, according to FIGS. 1 and 2. Consequently, the use of a special embroidery frame 27*a* is required, which is equipped with means for bridging the intermediate space formed between free arm 3 and embroidery device 21. Said means comprise a bridge part 30, which is preferably designed as one piece with embroidery frame 27*a*. Embroidery frame 27*a* is connected with embroidery frame carrier 25 in a conventional manner, whereby provision can be made for means for identifying the embroidery frame, as disclosed in German Utility/Design Patent No. 29614512 U1.

As mentioned above, when using embroidery device 21 with spacer element 29, a signal is triggered, said signal having the effect that the X-/Y-controller permits embroidery frame 27*a* to move only within a limited zone corresponding with the size conditions of the special embroidery frame 27*a*.

As an alternative to the mechanical connection means described above, it is, of course, possible to also use suitable docking and spacing elements of other suitable designs.

While only several embodiments of the present invention have been shown and described, it will be obvious to those skilled in the art that many modifications may be made to the present invention without departing from the spirit and scope thereof.

What is claimed is:

1. A method for embroidering tubular material on an embroidering device, comprising the steps of:

mounting an embroidering device on a free arm of a sewing machine through a connecting spacer element to define an intermediate space between the embroidering device and the free arm of the sewing machine, said embroidering device having an embroidering frame;

displacing said embroidering frame of said embroidering device above the free arm of the sewing machine; and, said spacer element enabling the passage of tubular material between said embroidering device and the free end of the sewing machine.

2. The method for embroidering tubular material on an embroidering apparatus according to claim 1, wherein said spacer element is formed as an element separate from said embroidery device.

3. An embroidering apparatus for embroidering tubular material on a free-arm sewing machine, said embroidering apparatus comprising:

an embroidering device having an embroidery frame;

means for detachably connecting said embroidering device to a free arm of a free-arm sewing machine;

first drive means for movement in an X-direction;

second drive means for movement in a Y-direction, said embroidery frame being horizontally displaceable above the free arm of the free-arm sewing machine by said first drive means in the X-direction and by said second drive means in the Y-direction, and a spacer element connected between said embroidery device and the free arm of the free-arm sewing machine for defining an intermediate space therebetween and for permitting the introduction of tubular material therebetween.

4. The embroidering apparatus for embroidering tubular material on a free-arm sewing machine according to claim 3, wherein said spacer element includes said means for detachably connecting said embroidering device to the free arm of the free-arm sewing machine.

5. The embroidering apparatus for embroidering tubular material on a free-arm sewing machine according to claim 3, wherein said spacer element is detachably connected with a base plate of the sewing machine and with said embroidery device.

6. The embroidering apparatus for embroidering tubular material on a free-arm sewing machine according to claim 3, further comprising means for scanning the presence of said spacer element, said means for scanning being located on said embroidery device.

7. The embroidering apparatus for embroidering tubular material on a free-arm sewing machine according to claim 6, wherein said means for scanning comprises a light barrier and a cam acting as a shutter.

8. The embroidering apparatus for embroidering tubular material on a free-arm sewing machine according to claim 3, further comprising means for bridging the intermediate space between the free arm of the free-arm sewing machine and said embroidery device.

9. The embroidering apparatus for embroidering tubular material on a free-arm sewing machine according to claim 8, wherein said means for bridging the intermediate space includes a bridge part as being part of said embroidery frame.

10. The embroidering apparatus for embroidering tubular material on a free-arm sewing machine according to claim 8, wherein said means for bridging the intermediate space includes a bridge part inserted between said embroidery device and said embroidery frame thereof.

11. The embroidering apparatus for embroidering tubular material on a free-arm sewing machine according to claim 3, wherein said spacer element is formed as an element separate from said embroidery device.

* * * * *